US009722361B2

(12) United States Patent
Tanaka et al.

(10) Patent No.: US 9,722,361 B2
(45) Date of Patent: Aug. 1, 2017

(54) CONNECTOR WITH SHIELD SHELL FOR CABLE

(71) Applicant: Yazaki Corporation, Tokyo (JP)

(72) Inventors: Masahiro Tanaka, Shizuoka (JP); Hajime Kato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/146,044

(22) Filed: Jan. 2, 2014

(65) Prior Publication Data

US 2014/0113489 A1 Apr. 24, 2014

Related U.S. Application Data

(63) Continuation of application No. PCT/JP2012/069068, filed on Jul. 20, 2012.

(30) Foreign Application Priority Data

Jul. 22, 2011 (JP) ..... 2011-161083

(51) Int. Cl.
*H01R 13/6581* (2011.01)
*H01R 13/6592* (2011.01)
(Continued)

(52) U.S. Cl.
CPC ..... *H01R 13/6581* (2013.01); *H01R 13/6592* (2013.01); *H01R 13/6591* (2013.01); *H01R 13/6593* (2013.01); *H01R 13/748* (2013.01)

(58) Field of Classification Search
CPC ..... H01R 13/6581; H01R 13/6589; H01R 13/6593
(Continued)

(56) References Cited

U.S. PATENT DOCUMENTS 4,609,238 A * 9/1986 Jamgotchian ..... H01R 11/30 439/39
5,718,605 A * 2/1998 Morikawa ..... 439/607.27
(Continued)

FOREIGN PATENT DOCUMENTS

JP 11-126661 A 5/1999
JP 2003-115357 A 4/2003
(Continued)

OTHER PUBLICATIONS

Communication issued on Feb. 10, 2015 by the Japanese Patent Office in related application No. 2011161083.
(Continued)

*Primary Examiner* — Renee Luebke
*Assistant Examiner* — Paul Baillargeon
(74) *Attorney, Agent, or Firm* — Sughrue Mion, PLLC

(57) ABSTRACT

A connector is provided to facilitate the connection work of a connection terminal and to enhance the connection reliability. A connector includes an attachment part that includes a terminal stand; a connector main body that includes a connection terminal connected to a cable, the connection terminal being fastened and fixed to the terminal stand in a state in which the connector main body is mounted to the attachment part; a cable shield shell that covers an introduction part for the cable in the connector main body; and a connection part shield shell that covers a fastening area between the connection terminal and the terminal stand so as to accommodate the cable shield shell inside the connection part shield shell.

6 Claims, 5 Drawing Sheets

(51) Int. Cl.
*H01R 13/6591* (2011.01)
*H01R 13/6593* (2011.01)
*H01R 13/74* (2006.01)

(58) Field of Classification Search
USPC ..... 439/607.27, 607.41, 607.55
See application file for complete search history.

(56) References Cited

U.S. PATENT DOCUMENTS

| | | | | |
|---|---|---|---|---|
| 6,056,592 | A | 5/2000 | Hashizawa et al. | |
| 7,097,498 | B2 | 8/2006 | Miyazaki | |
| 7,165,995 | B2 | 1/2007 | Fukushima et al. | |
| 7,306,475 | B2 | 12/2007 | Tsuruta | |
| 7,572,150 | B2 * | 8/2009 | Matsuoka | 439/626 |
| 2004/0266270 | A1 | 12/2004 | Miyazaki | |
| 2005/0191904 | A1 | 9/2005 | Fukushima et al. | |
| 2007/0207652 | A1 | 9/2007 | Tsuruta | |
| 2009/0137153 | A1 | 5/2009 | Yoshioka et al. | |
| 2012/0208404 | A1 | 8/2012 | Matsumoto et al. | |

FOREIGN PATENT DOCUMENTS

| | | | |
|---|---|---|---|
| JP | 3877139 | B2 | 2/2007 |
| JP | 2009272132 | A | 11/2009 |
| JP | 2011028853 | | 2/2011 |
| JP | 2011-100551 | A | 5/2011 |

OTHER PUBLICATIONS

International Search Report, dated Sep. 25, 2012, issued by the International Searching Authority, in counterpart Application No. PCT/JP2012/069068.

Written Opinion, dated Sep. 25, 2012, issued by the International Searching Authority, in counterpart Application No. PCT/JP2012/069068.

Communication issued on Jun. 2, 2015 by the Japanese Patent Office in related Application No. 2011-161083.

Office Action issued Nov. 13, 2015, issued by the European Patent Office in counterpart European Patent Application No. 12751128.5.

Office Action dated Dec. 2, 2015 issued by the State Intellectual Property Office of the People's Republic of China in counterpart Chinese Patent Application No. 201280036166.8.

Communication from the State Intellectual Property Office of the People's Republic of China, dated Jun. 3, 2015 in a counterpart Application No. 201280036166.8.

Communication from the State Intellectual Property Office of the People's Republic of China, dated May 23, 2016, in a counterpart Chinese Application No. 201280036166.8.

* cited by examiner

CONNECTOR WITH SHIELD SHELL FOR CABLE

CROSS REFERENCE TO RELATED APPLICATIONS

This application is a continuation of PCT application No. PCT/JP2012/069068, which was filed on Jul. 20, 2012 based on Japanese Patent Application (No. 2011-161083) filed on Jul. 22, 2011, the contents of which are incorporated herein by reference.

BACKGROUND OF THE INVENTION

1. Field of the Invention

The present invention relates to a connector for wiring by connecting cables to an attachment part of an electronic device or the like.

2. Description of the Related Art

A vehicle as a moving object includes a variety of electronic devices. For example, a hybrid car or an electronic car includes the electronic devices such as a three-phase alternate current motor or an inverter to convert a direct-current power from a battery to an alternating-current power and supply it to the motor. In order to connect the motor to the inverter, for example, a connector is used which is connected to the motor through an electrical wire (for example, see JP-A-11-126661). The connector is configured such that a connection terminal of power supply side is fastened and connected using bolts to a bus bar which is a terminal stand provided in a casing. In addition, a shield wire is configured such that an end part thereof is peeled and the connection terminal is connected to a core wire, and a braid is engaged with a shell member provided at a holding tube through the shell member so as to be grounded.

In addition, in a connector structure in which a connector and a terminal fitting of a connector attachment part are fastened to each other through holes by means of bolts, the connector structure having a detection member to detect that the holes are respectively covered with a cover that covers the holes and the connector attachment part is disclosed (see JP-A-2011-100551). FIG. 7 is an exploded perspective view of the connector in the related art in which the connector structure is applied. As shown in FIG. 7, a connector 81 in the related art is mounted on an attachment part 83 provided at a panel 82 of a device or the like. The attachment part 83 has a terminal stand (not indicated) to which the wiring in the device is connected. The connector 81 includes a connector main body 88 configured of a connection part 85 having connection terminals 84 and a cable introduction part 87 to which a cable 86 is introduced. Thus, the conductor of the cables 86 is made to conduct to the connection terminal 84. The connector 84 is arranged in an accommodation space S formed in the connection part 85.

In addition, the periphery of the connector main body 88 is covered by a shielding shell 89 which is made of metal. The shield layer (not indicated) of the cables 86 is made to conduct to the shield shell 89. In addition, the connector 81 includes a service cover 91 which is made of metal, to be attached to cover the upper portion of the connection part 85 of the connector main body 88.

In the connector 81, the terminal stand and the connection terminal 84 are connected by fastening of fastening bolts 93 in a state where the connector main body 88 is mounted on the attachment part 83. After that, a service cover 91 is arranged so as to cover the upper portion of the connection part 85 of the connector main body 88 and the service cover 91 and the connector main body 88 are fixed to the attachment part 83 of the panel 82 by fixing bolts 94.

SUMMARY OF THE INVENTION

In the connector 81, the shield shell 89 which enhances the electromagnetic shield effect with respect to each of the cables 86 is not covered by the service cover 91. Thus, the electromagnetic shield is accomplished with respect to each of cables 86 using only the shield shell 89. In addition, the connection areas between the terminal stand and the connection terminal 84 are located at the back of the accommodation space S of the connection part 85. In addition, the cable introduction part 87 extends above the connector main body 88 along the same direction as the fastening direction by the fastening bolts 93 of the connection terminal 84 and the terminal stand.

Accordingly, in order to enhance the electromagnetic shield effect of the cable shield shell 89, the cable shield shell 89 must be made thicker and larger, and it is difficult to make the cable shield shell 33 thinner and smaller.

In addition, since a tool interferes with the wall surface of the connection part 85 or the cable introduction part 87, the work for connection between the terminal stand and the connection terminal 84 by the fastening bolts 93 is hard to do. In addition, in a case where such a shield shell 89 is used, the outer wall section of the attachment part 83 as the insertion opening in which the connector main body 88 is inserted is blocked by the shield shell 89. As a result, there is a concern that the insertion of the connector main body 88 into the attachment part 83 may be incomplete.

In addition, the fastening areas are hardly checked visibly since it is difficult to confirm by visual inspection whether or not the connection terminal 84 is fastened at a regular position of the terminal stand. Thus, the terminal stand and the connection terminal 84 are forcedly fastened by the fastening bolts 93 in a state where the insertion of the connector main body 88 into the attachment part 83 is incomplete. Thus, there are concerns that deformation of the terminal stand or poor connection of the connection terminal 84 may be caused and the connection reliability may be decreased.

The present invention is achieved based on the situation described above. An object of the present invention is to provide a connector which can increase an electromagnetic shield effect with respect to the shield electric wire and can achieve a thinner and smaller shape.

In order to achieve the object described above, a connector according to an aspect of the present invention is characterized by any one of (1) to (3) described below.

(1) A connector, including:

an attachment part that includes a terminal stand;

a connector main body that includes a connection terminal connected to a cable, the connection terminal being fastened and fixed to the terminal stand in a state in which the connector main body is mounted to the attachment part;

a cable shield shell that covers an introduction part for the cable in the connector main body; and a connection part shield shell that covers a fastening area between the connection terminal and the terminal stand so as to accommodate the cable shield shell inside the connection part shield shell.

(2) The connector according to the configuration of (1), wherein the connector main body is configured such that the introduction part for the cable is inclined to a direction separate away from a fastening direction of the connection terminal to the terminal stand.

(3) The connector according to the configuration of (1) or (2), wherein the connector main body is molded in a state where the introduction part for the cable is embedded at a part of the connector main body.

In the connector having the configuration of (1) described above, in the connector main body which the connection part shield shell covers, each of the cables is covered by the cable shield shell and is also covered by the connection part shield shell. As a result, if sufficient electromagnetic shield effect may be anticipated with respect to each of the cables due to the connection part shield shell, even if the electromagnetic shield effect due to the cable shield shell is little, the cable shield shell can be made thinner and smaller since the influence of the electromagnetic shield effect with respect to each of the cables is little.

In the connector having the configuration of (2) described above, since the introduction part of the cables is inclined to a direction separate away from the fastening direction of the connection terminal to the terminal stand, when the connector main body is fitted from above in the attachment part, the attachment part as the insertion opening, into which the connector main body is inserted, is not blocked by the cable introduction part and the cable shield shell. The attachment part as the insertion opening is sufficiently visible so that fitting of the connector main body into the attachment part is easily performed and the insertion of the connector main body into the attachment part can be prevented from being incomplete beforehand. Accordingly, the connection work can be greatly improved, the connection trouble or the like do not occur at the connection locations between the terminal stand and the connection terminal and the connection reliability can be increased.

In the connector having the configuration of (3) described above, since the cable connected to the connection terminal is embedded, for example, by insert molding, when the connector main body is attached to the terminal stand, the attachment work of the connection terminal to the connector main body is not required. Thus, the load of the attachment work of the connector main body to the terminal stand can be alleviated. In addition, the cable connected to the connection terminal is embedded in the connector and thereby the introduction part for the cable can be easily maintained in the inclined state.

According to the aspect of the present invention, a connector can be provided which can increase the electromagnetic shield effect with respect to the shield electric wire and can achieve a thinner and smaller shape of the shield electric wire.

Hereinabove, the present invention is described briefly. Furthermore, details of the present invention will be further clarified by reading the embodiments of the present invention described below with reference to accompanying drawings.

DETAILED DESCRIPTION OF THE EXEMPLARY EMBODIMENTS

Hereinafter, an exemplary embodiment of the present invention is described with reference to drawings.

Figure 1:
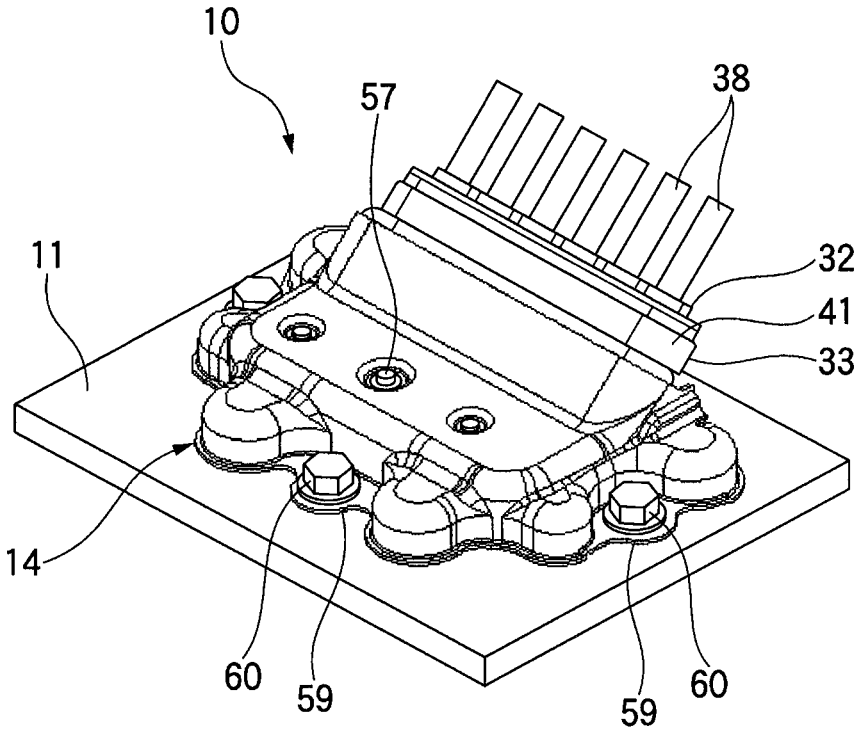
FIG. 1 is a perspective view of a connector according to an embodiment.
Figure 2:
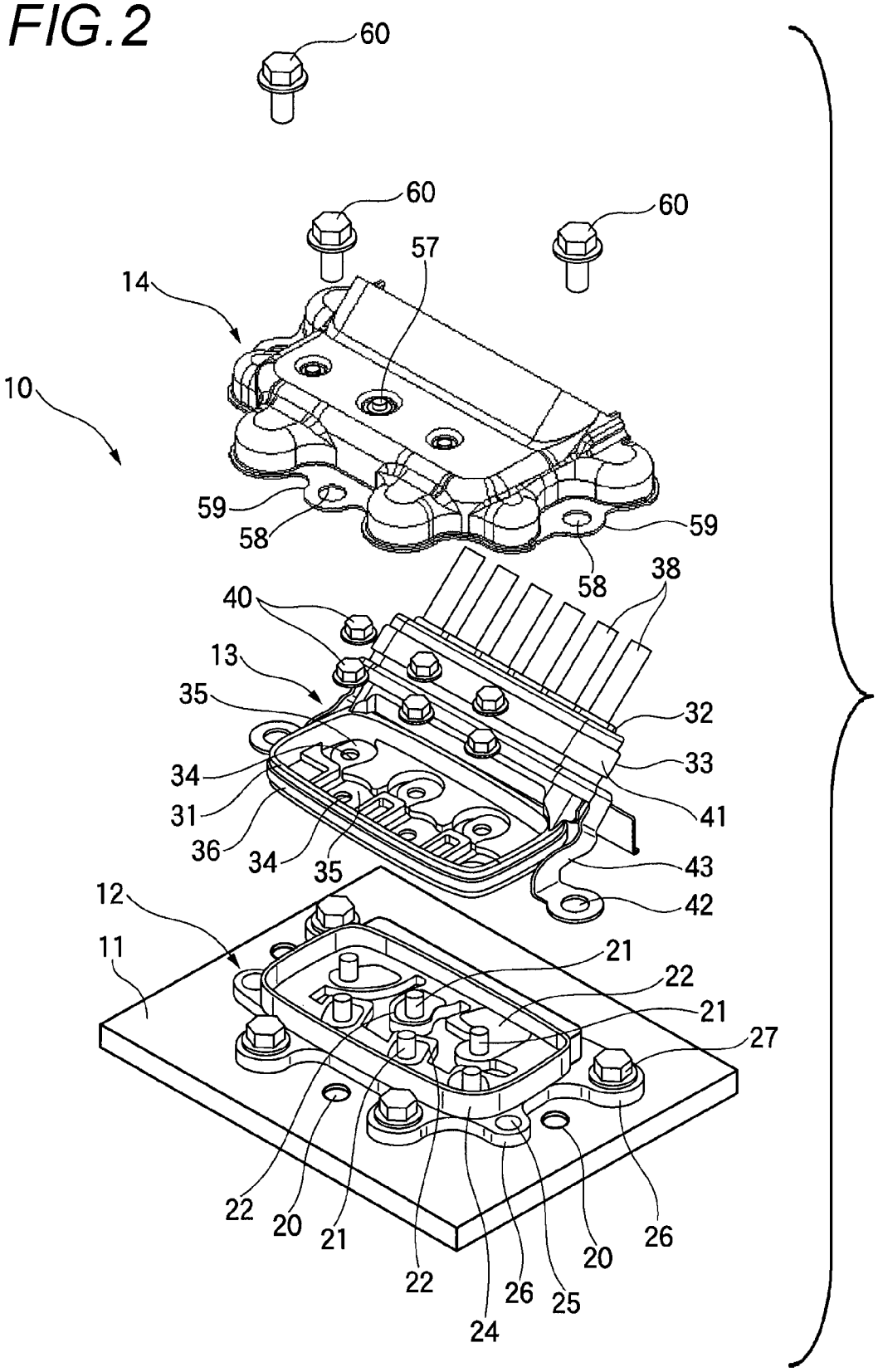
FIG. 2 is an exploded perspective view of the connector according to the embodiment.
Figure 3:
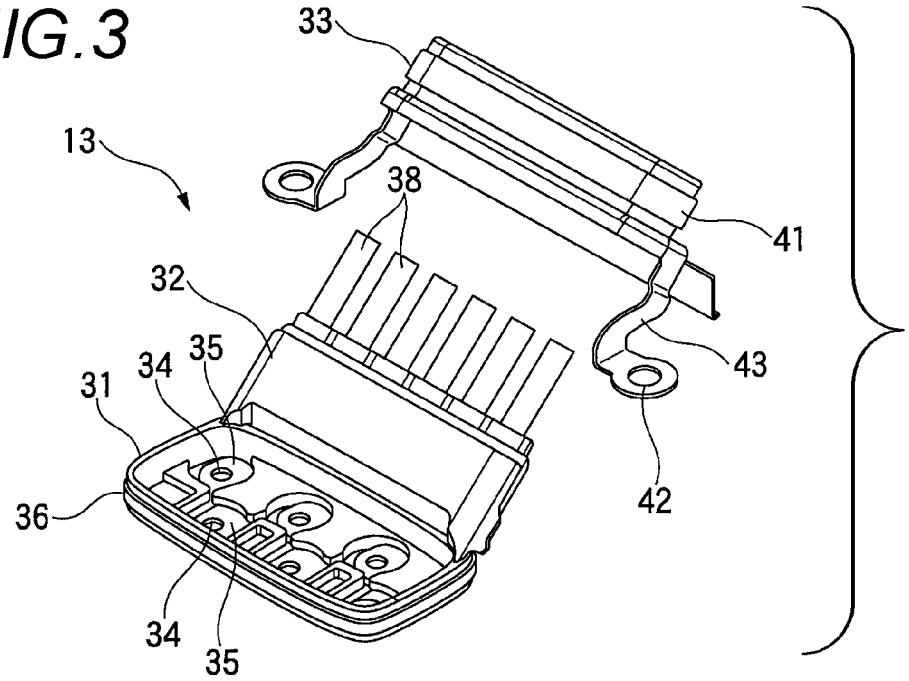
FIG. 3 is an exploded perspective view of the connector main body.
Figure 4:
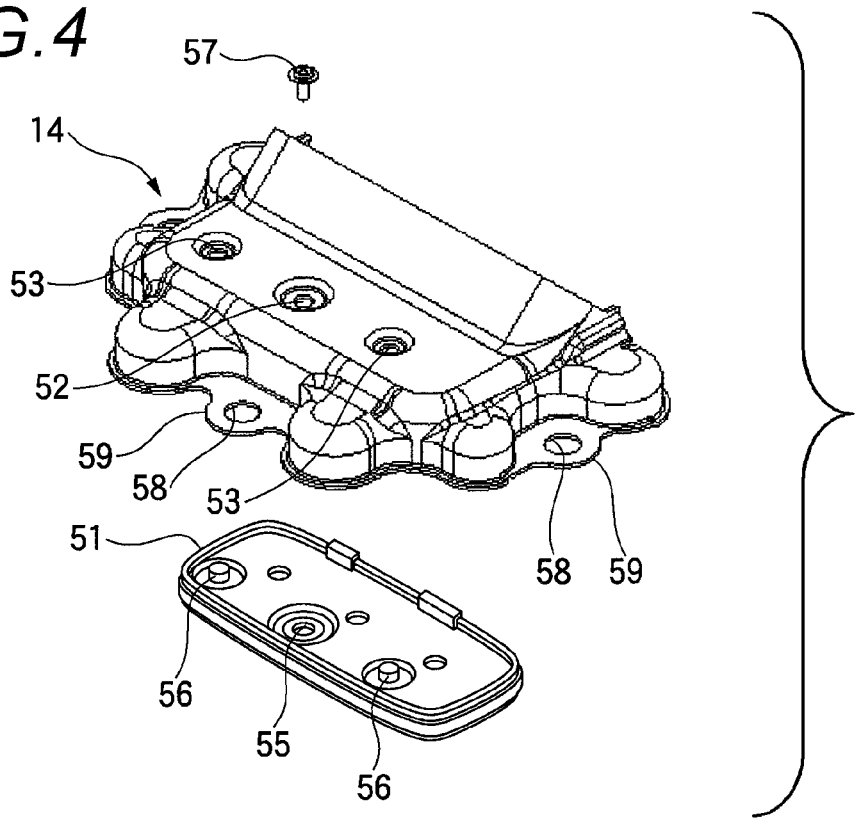
FIG. 4 is an exploded perspective view illustrating a connection part shield shell.

FIG. 1 is a perspective view of a connector according to the present embodiment, FIG. 2 is an exploded perspective view of the connector according to the present embodiment, FIG. 3 is an exploded perspective view of the connector main body and FIG. 4 is an exploded perspective view illustrating a connection part shield shell.

As shown in FIGS. 1 and 2, a connector 10 of the present embodiment is mounted on a panel 11 of various devices such as an inverter.

The connector 10 includes an attachment part 12 provided at the panel 11, a connector main body 13 attached to the attachment part 12, and a connection part shield shell 14 attached to the panel 11 so as to cover the attachment part 12 and the connector main body 13.

The attachment part 12 is attached to the panel 11 so as to cover an attachment hole (not indicated) formed at the panel 11 and includes a plurality of terminal stands 22 having fastening bolts 21. The terminal stands 22 include connection parts (not indicated) in the device side and wiring of the device side is connected to the connection parts.

The attachment part 12 has an outer wall section 24 to surround the terminal stand 22. A plurality of stay parts 26 having insertion holes 25 are formed in the periphery of the outer wall section 24. At the insertion holes 25 of the stay parts 26, bolts 27 are inserted and screws are screwed into screw holes 20 formed at the panel 11. Accordingly, the attachment part 12 is fastened and fixed to the panel 11.

As shown in FIG. 3, the connector main body 13 has a terminal plate section 31, a cable introduction part (an introduction part) 32 formed at one side of the terminal plate section 31 and a cable shield shell 33 to be attached to the cable introduction part 32.

At the terminal plate section 31, a plurality of connection terminals 35 having connection holes 34 are provided. At the cable introduction part 32, a plurality of cables 38 is embedded. A plurality of cables 38 are inserted when the connector main body 13 is molded so that the plurality of cables 38 are embedded in the cable introduction part 32. The cables 38 are configured of insulated cables in which the periphery of the conductor is covered by an outer coating. The conductor of each of the cables 38 is connected to the connection terminal 35. The cable introduction part 32 is inclined obliquely upward to deviate from above the terminal plate section 31 with respect to the terminal plate section 31.

The terminal plate section 31 is fitted from above in the outer wall section 24 of the attachment part 12 so that the connector main body 13 is mounted on the attachment part 12. When the terminal plate section 31 is fitted in the outer wall section 24 of the attachment part 12, the cable introduction part 32 and the cable shield shell 33, which are positioned deviated from above the terminal plate section 31, are positioned outside the outer wall section 24 of the attachment part 12. Thus, when the terminal plate section 31 is fitted from above in the outer wall section 24 of the attachment part 12, the outer wall section 24 of the attachment part 12 as an insertion opening, into which the connector main body 13 is inserted, is not blocked by the cable introduction part 32 and the cable shield shell 33. The outer wall section 24 of the attachment part 12 as the insertion opening is sufficiently visible so that fitting of the terminal plate section 31 into the outer wall section 24 is easily performed and the insertion of the connector main body 13 into the outer wall section 24 can be prevented from being incomplete beforehand.

The cable shield shell 33 is formed of a metal material and includes a shell main body 41 formed in an annular shape and fixing pieces 43 having hole sections 42 formed at both sides of the shell main body 41. The cable shield shell 33 is attached so that the shell main body 41 covers the periphery of the cable introduction part 32. In addition, in the shell main body 41, a shield layer such as braid or metal foil that covers the conductor via the insulated layer provided at each of cables 38 is connected and made to conduct. The outer periphery of the whole of the cable shield shell 33, including the shell main body 41 and the fixing pieces 43, is covered by the connection part shield shell 14 formed of the metal material described below. Thus, in the connector main body 13 on which the connection part shield shell 14 covers, each of the cables 38 is covered by the cable shield shell 33 and also covered by the connection part shield shell 14. As a result, with respect to each of the cables 38, the electromagnetic shield effect can be increased. Furthermore, if sufficient electromagnetic shield effect is expected with respect to each of the cables 38 by the connection part shield shell 14, since the influence of the electromagnetic shield effect with respect to each of the cables 38 is little even if the electromagnetic shield effect due to the cable shield shell 33 is little, the cable shield shell 33 can be made thinner and smaller.

As described above, the connector main body 13 where the cable shield shell 33 is attached can be attached by fitting the terminal plate section 31 thereof from above in the outer wall section 24 of the attachment part 12. Thus, as described above, when the terminal plate section 31 is fitted in the outer wall section 24 of the attachment part 12, the fastening bolts 21 of the attachment part 12 are inserted into the connection holes 34 of the connection terminal 35 of the terminal plate section 31. In this state, as shown in FIG. 2, fastening nuts 40 are fastened to the fastening bolts 21 so that the terminal stand 22 of the attachment part 12 and the connection terminal 35 are connected and the wiring of the device side connected to the terminal stand 22 and the conductor of the cables 38 are made to conduct.

As described above, the connector 10 according to the present embodiment is configured such that when the terminal plate section 31 is fitted from above in the outer wall section 24 of the attachment part 12, the outer wall section 24 of the attachment part 12 as the insertion opening is sufficiently visible. Accordingly, the fitting of the terminal plate section 31 in the outer wall section 24 can be easily performed and the insertion of the connector main body 13 into the outer wall section 24 can be prevented from being incomplete beforehand. As a result, the fastening nuts 40 can be prevented from fastening to the fastening bolts 21 in a state where the insertion of the fastening bolts 21 into the connection holes 34 is incomplete.

Here, the connector main body 13 is inclined obliquely upward so that the cable introduction part 32 deviates from above the terminal plate section 31 with respect to the terminal plate section 31. Accordingly, the cable introduction part 32 is inclined to a direction separate away from the fastening direction of the connection terminal 35 to the terminal stand 22, and above the fastening areas of the connection terminal 35 and the terminal stand 22 becomes an opened state.

Accordingly, when connection work of the connection terminal 35 to the terminal stand 22 is performed by the fastening nuts 40, the work can be easily performed while checking visibly the fastening areas of which above is opened.

In addition, as described above, when the connector main body 13 is attached to the attachment part 12, the fixing pieces 43 of the cable shield shell 33 of the connector main body 13 are arranged on the surface of the panel 11 and the hole sections 42 of the fixing pieces 43 are communicated with the screw holes 20 formed at the panel 11.

The connection part shield shell 14 is formed of the metal material and as shown in FIG. 4, includes a service cover 51. At the connection part shield shell 14, a screw insertion hole 52 and engaging holes 53 are formed. The service cover 51 forms a screw hole 55 communicating with the screw insertion hole 52. In addition, at the service cover 51, engaging protrusions 56 are formed which can engage with the engaging holes 53.

The service cover 51 is attached to the connection part shield shell 14 from inside thereof. The service cover 51 is fitted from inside of the connection part shield shell 14 so that the engaging protrusions 56 are inserted into the engaging holes 53 and arranged at predetermined positions with respect to the connection part shield shell 14. In addition, when the service cover 51 is fitted from inside of the connection part shield shell 14, the screw insertion hole 52 and the screw hole 55 communicate with each other. In this state, when a screw 57 inserts into the screw insertion hole 52 and the screw 57 is threaded into the screw hole 55, the service cover 51 is attached to the connection part shield shell 14.

The outer periphery of the connection part shield shell 14 has fastening pieces 59 where bolt insertion holes 58 are formed.

When the connection part shield shell 14 covers the attachment part 12 and the connector main body 13, the bolt insertion holes 58 are made to communicate with the screw holes 20 formed at the panel 11. In addition, at a portion where the fixing piece 43 of the cable shield shell 33 is arranged, the bolt insertion holes 58 are communicated with the hole sections 42 of the fixing piece 43 communicated with the screw holes 20 of the panel 11. In addition, in a case where the connection part shield shell 14 covers the attachment part 12 and the connector main body 13, the connection part shield shell 14 covers the fastening areas between the connection terminal 35 and the terminal stand 22 in order to accommodate the cable shield shell 33 inside thereof in a state where the service cover 51 is held between the connection part shield shell 14 and the connector main body 13. Thus, in the connector main body 13 on which the connection part shield shell 14 covers, each of the cables 38 is covered by the cable shield shell 33 and also covered by the connection part shield shell 14. As a result, the electromagnetic shield effect with respect to each of the cables 38 can be increased. Furthermore, if sufficient electromagnetic shield effect is expected with respect to each of the cables 38 by the connection part shield shell 14, since the influence of the electromagnetic shield effect to each of the cables 38 is little even if the electromagnetic shield effect due to the cable shield shell 33 is little, the cable shield shell 33 can be made thinner and smaller.

Thus, as described above, in a state where the connection part shield shell 14 covers the attachment part 12 and the connector main body 13, when the fastening bolt 60 is inserted into each of the bolt insertion holes 58 and the screws insert into the screw holes 20 of the of the panel 11, the connection part shield shell 14 is fastened and fixed to the panel 11 and the connection part shield shell 14 is made to conduct to the panel 11. In addition, at a portion where the fixing pieces 43 of the cable shield shell 33 are arranged, the fixing pieces 43 are pinched by the panel 11 and the connection part shield shell 14, and the cable shield shell 33 is made to conduct to the connection part shield shell 14 and the panel 11.

Accordingly, at the connector 10, the connector main body 13 is covered by the connection part shield shell 14 made of the metal material and communicated with the panel 11, and the cable shield shell 33. Thus, the connection locations between the terminal stand 22 and the connection terminal 35 in the connector main body 13, the end sections of the cables 38 and the periphery thereof are sealed.

As described above, in the connector according to the embodiment described above, at the connector main body 13 which covers the connection part shield shell 14, each of the cables 38 is covered by the cable shield shell 33 and also covered by the connection part shield shell 14. As a result, if sufficient electromagnetic shield effect is expected with respect to each of the cables 38 by the connection part shield shell 14, since the influence of the electromagnetic shield effect to each of the cables 38 is little even though the electromagnetic shield effect is little by the cable shield shell 33, the cable shield shell 33 can be made thinner and smaller.

In the connector according to the present embodiment described above, when the terminal plate section 31 is fitted from above in the outer wall section 24 of the attachment part 12, the outer wall section 24 of the attachment part 12 as the insertion opening, to which the connector main body 13 is inserted, is not blocked by the cable introduction part 32 and the cable shield shell 33. The outer wall section 24 of the attachment part 12 as the insertion opening is sufficiently visible so that the fitting of the terminal plate section 31 in the outer wall section 24 can be easily performed and the insertion of the connector main body 13 into the outer wall section 24 can be prevented from being incomplete beforehand. Accordingly, since the fastening nuts 40 can be prevented from fastening to the fastening bolts 21 in a state where the insertion of the fastening bolts 21 into the connection holes 34 is incomplete, the damage of the connector 10 due to occurrence of crack or the like can be prevented.

In addition, in the connector according to the embodiment described above, since above the connector main body 13 attached to the attachment part 12 is opened, checking and visibility in the fastening areas of the connection terminal 35 to the terminal stand 22 can be largely improved. Accordingly, when the connection terminal 35 of the terminal plate section 31 is fastened and connected to the terminal stand 22 of the attachment part 12 by the fastening nuts 40, the connection work can be easily performed while the locations of the connection work can be checked visibly. Accordingly, the connection work can be largely improved, the connection failure or the like does not occur at the connection locations between the terminal stand 22 and the connection terminal 35, and the connection reliability can be increased.

Figure 5:
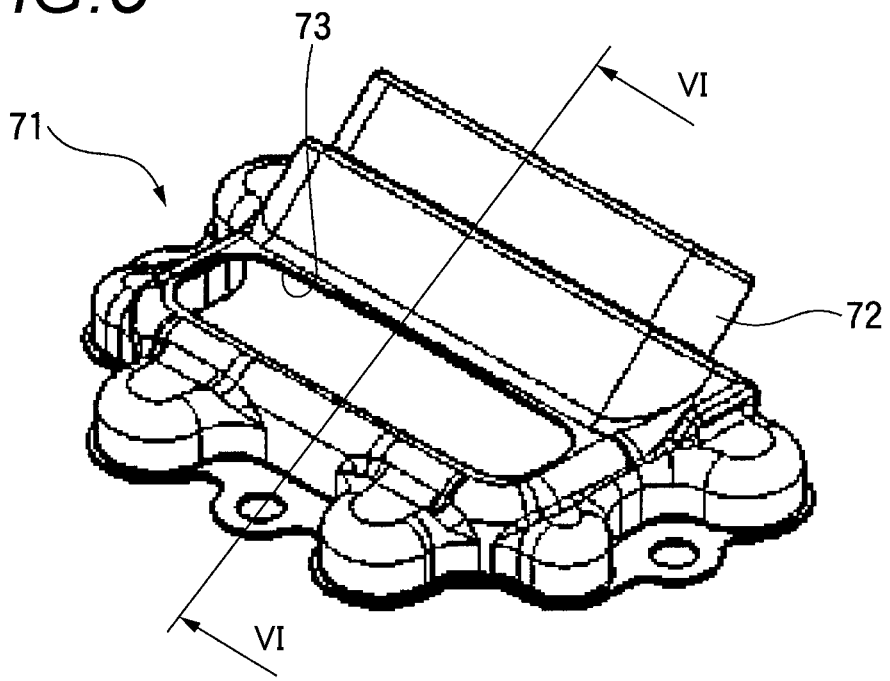
FIG. 5 is a perspective view illustrating an integrated-type shield shell.
Figure 6:
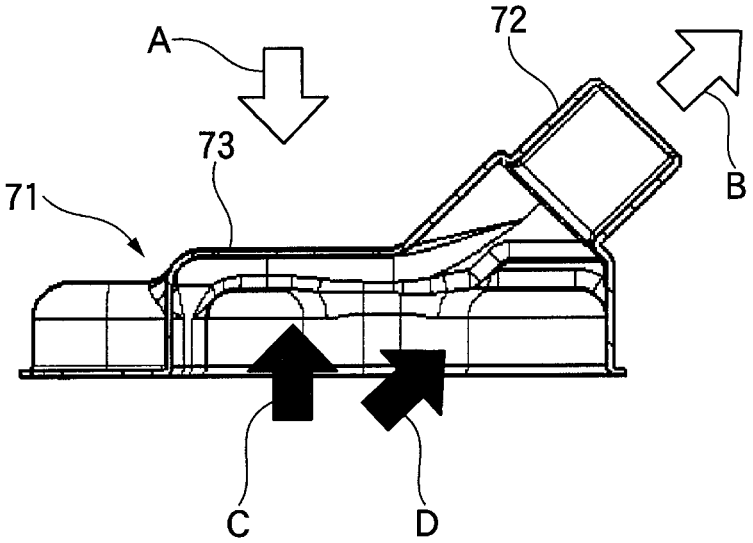
FIG. 6 is a cross-sectional view taken along arrows VI-VI in FIG. 5 illustrating the integrated-type shield shell.
Figure 7:
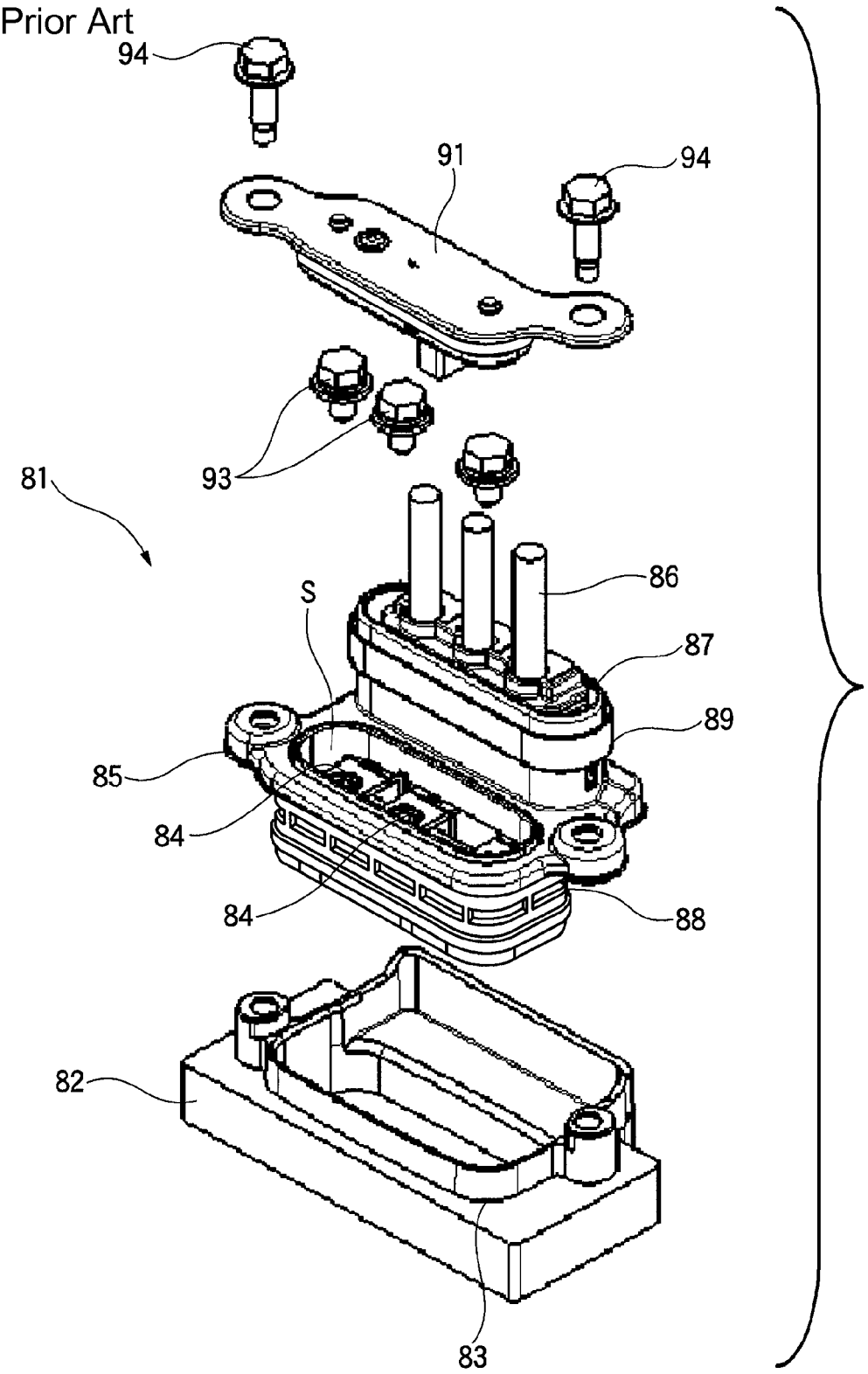
FIG.7 Prior Art
FIG. 7 is an exploded perspective view of the connector of the related art.

FIGS. 5 and 6 illustrate an integrated-type shield shell where the connection part shield shell 14 and the cable shield shell 33 are integrally formed in the connector according to the present embodiment. As shown in FIG. 5, an integrated-type shield shell 71 has a cable insertion part 72, into which the cables 38 are inserted, and a window area 73 formed to connect the terminal stand 22 and the connection terminal 35.

At the integrated-type shield shell 71, the cables 38 and the cable introduction part 32 are inserted into the cable insertion part 72, the cables 38 are connected to the connector main body 13. Furthermore, a shield layer of the cables 38 is made to conduct to the integrated-type shield shell 71. After that, the connector main body 13 is mounted on the attachment part 12 and thereby the integrated-type shield shell 71 covers thereon. The terminal stand 22 and the connection terminal 35 are fastened by the fastening nuts 40 from the window area 73, and after that, the shield cover (not indicated) is attached to the window area 73 so that the window area 73 is blocked.

In a case where the integrated-type shield shell 71 is used, the outer wall section 24 of the attachment part 12 as the insertion opening, where the connector main body 13 is inserted, is blocked by the cable introduction part 32 and the cable shield shell 33. As a result, there is a concern that the insertion of the connector main body 13 into the outer wall section 24 may be incomplete. In addition, since the integrated-type shield shell 71 has been attached state to the connector main body 13 beforehand, the installation work to the attachment part 12 and the work for fastening between the terminal stand 22 and the connection terminal 35 by the fastening nuts 40 may be complicated.

In addition, the cable insertion part 72 is also inclined to be matched with the cable introduction part 32 of the connector main body 13. Accordingly, as shown in FIG. 6, an introduction direction B of the cable 38 with respect to a fastening direction A between the terminal stand 22 and the fastening nuts 40 is inclined. Thus, in order to perform press process of the integrated-type shield shell 71, the press work should be performed from two directions of a C direction and a D direction so that costs may increase due to the complexity of the manufacturing process.

In contrast, according to the present embodiment, when the terminal plate section 31 is fitted from above in the outer wall section 24 of the attachment part 12, the outer wall section 24 of the attachment part 12 as the insertion opening, which inserts the connector main body 13, is not blocked by the cable introduction part 32 and the cable shield shell 33. The outer wall section 24 of the attachment part 12 as the insertion opening is sufficiently visible so that the fitting of the terminal plate section 31 into the outer wall section 24 can be easily performed and the insertion of the connector main body 13 into the outer wall section 24 can be prevented from being incomplete beforehand. Accordingly, the fastening nuts 40 can be prevented from fastening to the fastening bolts 21 in a state where the insertion of the fastening bolts 21 into the connection holes 34 is incomplete. In addition, according to the present embodiment, since the connection part shield shell 14 covering the fastening areas between the connection terminal 35 and the terminal stand 22, and the cable shield shell 33 covering the cable introduction part 32 in the connector main body 13 are provided, the fastening work can be easily performed in a state where the fastening areas of the connection terminal 35 are exposed even though the cable shield shell 33 is attached, compared to using the integrated-type shield shell 71 where the cable insertion part 72 covering the cable insertion part 32 and the portion covering the fastening areas of the connection terminal 35 are integrated. In addition, it is possible to achieve simplification of the manufacturing process by simplifying the shape, and thereby achieving to be smaller and low cost.

Furthermore, the invention is not limited to the embodiments described above and accordingly, modifications, improvements, or the like are possible. In addition, material, shape, dimension, the number, arrangement locations or the like of each of constitutional elements is arbitrary and is not limited if it can achieve the invention.

The connector as described above is useful, because an electromagnetic shield effect with respect to the shield electric wire is increased and a thinner and smaller shaped connector is available, for example, to provide such connector in a small space of a vehicle.

What is claimed is:

1. A connector mounted on a panel, comprising:

a connector main body including:

a terminal plate section in which a connection terminal connected to a cable is provided; and an introduction part accommodating the cable;

an attachment part fastened to the panel so as to cover an attachment hole formed in the panel, the attachment part including:

a terminal stand;

an outer wall enclosure surrounding the terminal stand and protruding in a first direction from the panel thereby forming an enclosed space extending in the first direction above the panel; and a fastening bolt standing upward on a surface of the terminal stand in the enclosed space protruding from the panel and toward the connector main body in the first direction, the fastening bolt on the terminal stand being inserted into a connection hole of the connection terminal thereby the connection terminal being fastened and fixed to the terminal stand;

a panel on which the attachment part is provided;

a cable shield shell covering the introduction part for the cable in the connector main body; and a connection part shield shell covering a fastening area between the connection terminal and the terminal stand so as to accommodate the cable shield shell inside the connection part shield shell, wherein:

the cable shield shell is connected to a shield layer of the cable, and the cable shield shell is fixed to the panel via a fastening part of the connection part shield shell, and the terminal plate section of the connector main body is inserted into the enclosed space extending in the first direction of the outer wall enclosure of the attachment part in the first direction, insertion of the terminal plate section into the enclosed space guides the fastening bolt on the terminal stand to be inserted into the connection hole of the connection terminal in the first direction, thereby positioning the connection terminal on the terminal stand in a fastening position.

2. The connector according to claim 1, wherein the connector main body is configured such that the introduction part for the cable is inclined to a direction separate away from a fastening direction of the connection terminal to the terminal stand.

3. The connector according to claim 1, wherein the connector main body is molded in a state where the introduction part for the cable is embedded at a part of the connector main body.

4. The connector according to claim 1, wherein the panel includes a screw hole, the cable shield shell includes a shell main body and a fixing piece having a hole section formed at a side of the shell main body, the connection part shield shell includes a bolt insertion hole, the screw hole of the panel, the hole section of the cable shield shell and the bolt insertion hole of the connection part are communicated with each other with a bolt inserted therethrough so that the connection part shield shell is electrically conducted with the panel and the fixing piece of the cable shield shell is pinched by the panel and the connection part shield shell.

5. The connector according to claim 1, wherein the connector main body is provided in the enclosed space above the panel after being inserted into the enclosed space.

6. The connector according to claim 1, wherein the attachment part includes a plurality of stay parts provided on an outer surface of the outer wall enclosure, and wherein the attachment part is fixed to the panel by the plurality of stay parts being fixed to the panel.

* * * * *